US009598937B2

(12) United States Patent
Chen et al.

(10) Patent No.: US 9,598,937 B2
(45) Date of Patent: Mar. 21, 2017

(54) ROTATING MAGNETIC FIELD DOWNHOLE POWER GENERATION DEVICE

(75) Inventors: Wei Chen, Shandong (CN); Laiju Han, Shandong (CN); Zuohui Li, Shandong (CN); Feng Sun, Shandong (CN); Yifeng Wang, Shandong (CN); Qinglong Liu, Shandong (CN); Fengling Xu, Shandong (CN); Zhenhua Lv, Shandong (CN)

(73) Assignees: CHINA PETROLEUM & CHEMICAL CORPORATION, Beijing (CN); SHENGLI DRILLING TECHNOLOGY RESEARCH INSTITUTE OF SINOPEC, Dongying, Shandong (CN)

( * ) Notice: Subject to any disclaimer, the term of this patent is extended or adjusted under 35 U.S.C. 154(b) by 451 days.

(21) Appl. No.: 14/241,903

(22) PCT Filed: Aug. 28, 2012

(86) PCT No.: PCT/CN2012/080650
§ 371 (c)(1),
(2), (4) Date: Apr. 17, 2014

(87) PCT Pub. No.: WO2013/029524
PCT Pub. Date: Mar. 7, 2013

(65) Prior Publication Data

US 2014/0251592 A1 Sep. 11, 2014

(30) Foreign Application Priority Data

Aug. 30, 2011 (CN) ..... 2011 1 0252606

(51) Int. Cl.
*E21B 47/18* (2012.01)
*F03B 13/02* (2006.01)
(Continued)

(52) U.S. Cl.
CPC ..... *E21B 41/0085* (2013.01); *E21B 4/04* (2013.01); *E21B 47/182* (2013.01); *F03B 13/02* (2013.01)

(58) Field of Classification Search
CPC ..... E21B 43/128; E21B 41/0085; E21B 4/04; E21B 7/068; E21B 47/182; F04D 29/048; F03B 13/02
See application file for complete search history.

(56) References Cited

U.S. PATENT DOCUMENTS 4,546,836 A 10/1985 Dennis et al.
5,517,464 A 5/1996 Lerner et al.
(Continued)

FOREIGN PATENT DOCUMENTS

CA 961026 A 1/1975
CN 2704959 Y 6/2005
(Continued)

*Primary Examiner* — Michael Wills, III
(74) *Attorney, Agent, or Firm* — Novick, Kim & Lee, PLLC; Allen Xue

(57) ABSTRACT

The present disclosure relates to a downhole rotating magnetic field generator, wherein a stator assembly is formed by fixedly connecting a guiding stator, windings, and a body together, and a rotor assembly is formed by mounting a turbine rotor and a permanent magnet together. Between the stator assembly and the rotor assembly, sliding bearings are arranged and small mud passages are formed. There is no metal isolation between the rotor and the stator for cutting through the magnetic lines of force, so that the eddy current loss is relatively small. Meanwhile, with mud flowing through the passages as lubricant, overheating of the generator can be prevented and high power output can be ensured.

16 Claims, 1 Drawing Sheet

(51) Int. Cl.
*E21B 41/00* (2006.01)
*E21B 4/04* (2006.01)

(56) References Cited

U.S. PATENT DOCUMENTS

| | | | | |
|---|---|---|---|---|
| 7,133,325 | B2 * | 11/2006 | Kotsonis | E21B 41/0085 175/48 |
| 8,297,375 | B2 * | 10/2012 | Hall | E21B 4/14 175/107 |
| 8,853,879 | B2 * | 10/2014 | Rytlewski | H02K 7/1823 290/54 |
| 2010/0183430 | A1 * | 7/2010 | Winnacker | E21B 4/02 415/141 |
| 2012/0139250 | A1 * | 6/2012 | Inman | E21B 21/10 290/52 |

FOREIGN PATENT DOCUMENTS

| | | | |
|---|---|---|---|
| CN | 200993072 | Y | 12/2007 |
| CN | 101126366 | A | 2/2008 |
| CN | 101982654 | A | 3/2011 |
| CN | 202220711 | U | 5/2012 |
| DE | 3938749 | A1 | 5/1991 |
| GB | 2467046 | A | 7/2010 |

* cited by examiner

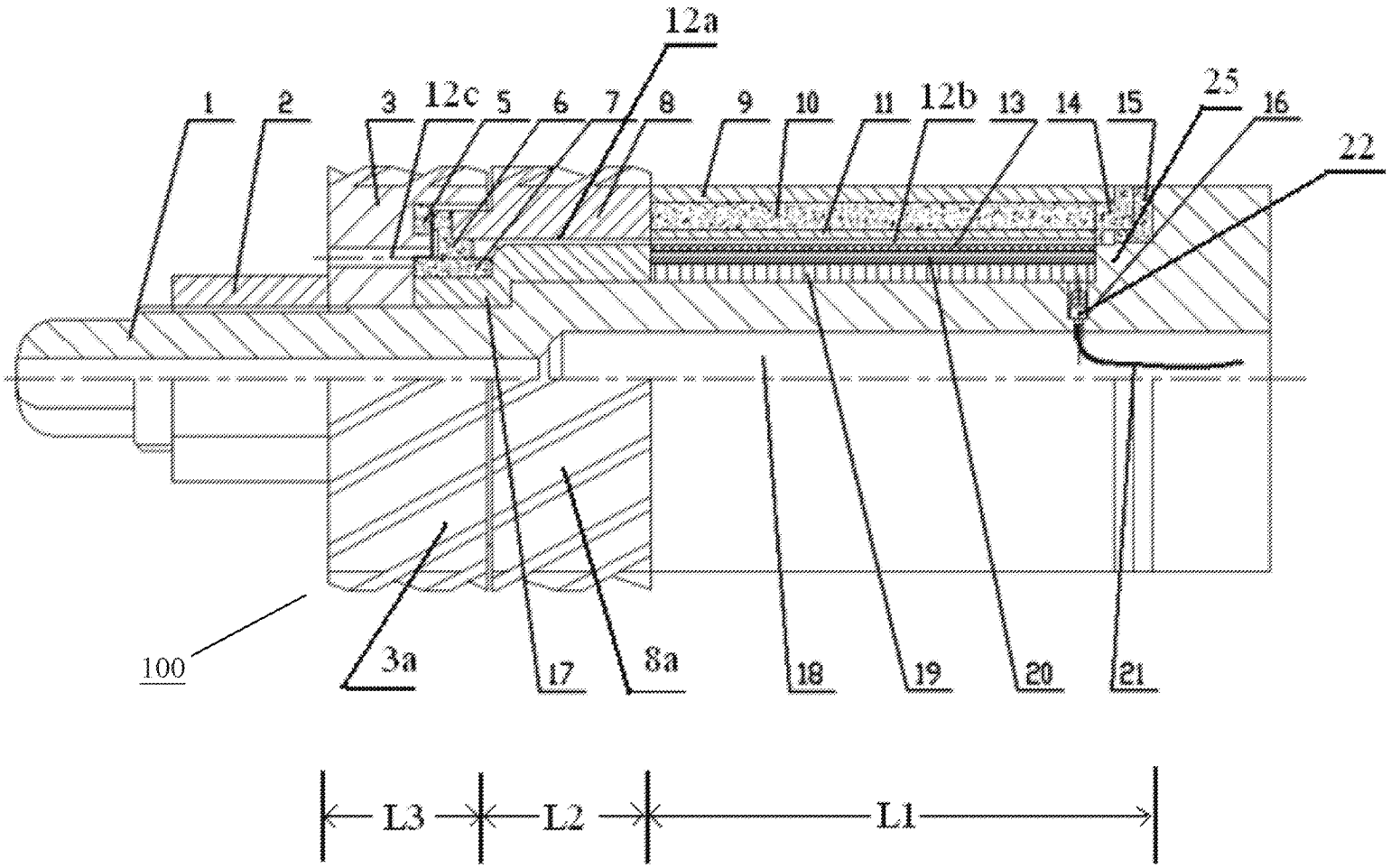
22
16
25
15
14
13
12b
11
10
9
12a
8
7
6
5
12c
3
2
1
21
20
19
18
8a
17
3a
100
L1
L2
L3

ROTATING MAGNETIC FIELD DOWNHOLE POWER GENERATION DEVICE

FIELD OF THE INVENTION

The present disclosure relates to the technical field of oil and gas drilling, in particular to a downhole mud-driven rotating magnetic field generator.

BACKGROUND OF THE INVENTION

With the development of modern oil and gas drilling technology, measuring while drilling tool (MWD tool) is more and more widely used in the drilling process. The MWD tool transmits the underground data to the ground by means of mud pulse, electromagnetic wave, or sound wave, so that the technicians on the ground can analyze the data and then adjust the drilling progress accordingly.

In the prior art, power is supplied to a downhole MWD tool mainly in two ways, namely through battery pack and through generator. Because the capacity and safety of a battery pack are greatly affected by the temperature, when the temperature reaches 120° C., the capacity of the battery pack decreases by 20%. The temperature limit of a battery pack is about 175° C. In addition, the transducer and electronic circuits of the MWD tool only require a few or a dozen watts of power, however, part of the underground measuring and controlling system can consume as much as 700 watts. To prolong the operation time of the tool underground, downhole generator is mainly used as the power source for the MWD tool at present, which supplies power for the battery and/or the transducer group and the signal generating device.

U.S. Pat. No. 5,517,464 discloses an MWD tool which integrates a mud pulse generator and a turbine generator. The turbine generator comprises a turbine impeller, a drive shaft, a transmission, a three-phase alternator, and a rotational speed measurement device. Because the space underground is limited and the generator can only provide relatively low power, the turbine generator cannot meet the requirement of the drilling process. In addition, in this device, a gearbox is used to obtain the rotary speed response from the turbine and the generator, which adds complexity to the structure of the MWD tool. Moreover, since the coils directly contact the mud, it requires highly of the mud quality, bearing performance, and the insulation of the coils; and the coils are easy to be damaged at high speed under severe environment, such as high temperature and intense vibration, for long terms.

CN 201010533100.2 discloses a petroleum drilling mud generating system which comprises coil windings, a magnet, an impeller, an upper plug, a lower plug, a central shaft, and an isolation sleeve, wherein the magnet is embedded in the impeller hub; the coil windings are fixed in a closed cavity formed by the central shaft, the upper and lower plugs, and the isolation sleeve; and the impeller hub is in clearance fit with the isolation sleeve. When the mud with pressure flushes from top to bottom, the flushed impeller rotates so that the magnet embedded in the impeller hub rotates synchronously with the impeller, and the coils cut through the magnetic lines of force to generate power. Moreover, an abrasion-resistant alloy sleeve is provided between the impeller and the isolation sleeve, which provides supporting and straightening functions when the impeller rotates. And a shock absorber is provided between the alloy sleeve and the plugs, so as to reduce influence of the mud impact on the abrasion-resistant alloy sleeve.

This petroleum drilling mud generating system is advantageous in that it no longer uses dynamic seal. However, it adopts clearance fit between the rotor and the isolation sleeve, with mud as the lubricant, so as to fulfill the functions of supporting and straightening. When operating at high speed in the mud, because sand unavoidably exists in the mud, sand stuck can easily occur, causing the whole system to fail and mud lubrication failure. In addition, the metal isolation sleeve, which is placed between the magnet and the coil windings, suffers from eddy current loss in a changing magnetic field, making it very difficult for the system to generate high power. In the meantime, eddy current loss directly manifests as heat, causing temperature rise.

SUMMARY OF THE INVENTION

The present disclosure provides a downhole rotating magnetic field generator, comprising: a stator assembly, comprising a stationary cylindrical body and windings arranged in a first region of the body; and a rotor assembly, comprising a permanent magnet arranged radially outside of the windings and a turbine rotor arranged in a second region of the body which is axially adjacent to the first region, wherein the turbine rotor and the permanent magnet are fixedly connected with each other along an axial direction, and arranged on the body at both ends of the rotor assembly respectively through a first bearing and a second bearing.

In an embodiment according to the present disclosure, a first internal fluid passage and a second internal fluid passage, which are communicated with each other, are formed respectively between the turbine rotor and the body and between the permanent magnet and the windings, so that a part of fluid passing through the generator enters the first internal fluid passage through the first bearing and then is discharged through the second bearing after flowing through the second internal fluid flow passage.

In one embodiment, a first external fluid passage is arranged on the periphery of the turbine rotor.

According to the present disclosure, a guiding stator is arranged on a third region of the body which is axially adjacent to the second region, a second external fluid passage is arranged on the periphery of the guiding stator, and a third internal fluid passage communicated with the first internal fluid passage is arranged inside the guiding stator.

According to a preferred embodiment of the present disclosure, an adjusting ring is arranged between the turbine rotor and the body, the first internal fluid passage being arranged between the turbine rotor and the adjusting ring, and the first bearing being placed on the periphery of the adjusting ring.

According to another preferred embodiment of the present disclosure, a slip ring is arranged between the guiding stator and the first bearing.

According to the present disclosure, the first bearing comprises a rotor upper bearing and a radial bearing, and the second bearing comprises a rotor lower bearing and a body bearing.

According to a preferred embodiment, an insulation layer is formed radially outside of the windings.

According to another preferred embodiment, a yoke and a non-magnetically conductive shield are respectively arranged radially outside and inside of the permanent magnet, the second internal fluid passage being arranged between the insulation layer and the non-magnetically conductive shield.

According to the present disclosure, the body comprises an axial inner passage and a radial passage arranged in the first region thereof, an electrical lead, which passes through a radial passage in a sealed manner and connects to the windings, is used to output the electric power and/or signal generated.

BRIEF DESCRIPTION OF THE DRAWINGS

The present disclosure will be described in detail below with reference to the accompanying drawings. It should be understood that the drawings are provided only to better illustrate the present disclosure, and should not be construed as limitations thereto. In the drawings, FIG. 1 schematically shows the structure of a downhole rotating magnetic field generator according to the present disclosure.

DETAILED DESCRIPTION OF THE EMBODIMENTS

A specific embodiment according to the present disclosure will be described below with reference to FIG. 1.

The downhole rotating magnetic field generator 100 according to the present disclosure mainly comprises a stator assembly and a rotor assembly. The stator assembly comprises a stationary, cylindrical body 1. The cylindrical body 1, as a mounting base of the whole generator, is configured as an elongated shaft-shaped member. All the components of the generator 100 can be mounted on the cylindrical body 1. Windings 20 are arranged on a certain region of the body 1 (namely a first region L1). In one specific embodiment, a projection 25 in form of an integral step is arranged on one end (the right end in FIG. 1) of the first region L1, so that the windings 20 can be positioned axially thereon.

In a preferred embodiment, an insulation layer 13 is arranged radially outside of the windings 20, and a set of laminations 19 is arranged radially inside of the windings 20. During operation, the body 1 does not rotate. Therefore, the windings 20, the set of laminations 19, and the insulation layer 13 do not rotate during operation, either.

According to the present disclosure, the rotor assembly comprises a permanent magnet 10 arranged in the first region L1 of the body 1. The magnet 10 is also located radially outside of the windings 20, and one end (the right end in FIG. 1) thereof is defined by a second bearing, namely a lower bearing 14 and a body bearing 15.

A turbine rotor 8 is arranged on one side (the left side in FIG. 1) of a second region L2 of the body 1 which is adjacent to the first region L1. The turbine rotor 8 is axially adjacent to and fixed connected with the permanent magnet 10. The rotor assembly is arranged on the body 1 at both ends thereof respectively through the first bearing and the second bearing. The first bearing and the second bearing can both be, for example, sliding bearings.

In a preferred embodiment, a yoke 9 can be arranged outside of the permanent magnet 10. The yoke 9 is fixedly connected to both the turbine rotor 8 and the permanent magnet 10, so that the turbine rotor 8 and the permanent magnet 10 can rotate as a whole. Preferably, a non-magnetically conductive shield 11 can be arranged inside of the permanent magnet 10 to protect the permanent magnet 10.

A first external fluid passage 8*a* is arranged on the periphery of the turbine rotor 8. During operation of the generator 100 underground, fluid, such as mud, flows through the first external fluid passage 8*a*, so as to drive the turbine rotor 8 to rotate. Because the permanent magnet 10 is fixedly connected to the turbine rotor 8, it rotates therewith. Thus, the rotating permanent magnet moves relative to the stationary windings 20 by cutting through the magnetic lines of force, so as to generate power.

According to a preferred embodiment, a first internal fluid passage 12*a* is arranged between the turbine rotor 8 and the body 1, and a second internal fluid passage 12*b* is arranged between the permanent magnet 10 and the windings 20. The first internal fluid passage 12*a* and the second internal fluid passage 12*b* are communicated with each other.

In this case, during operation of the generator 100 underground, most of the mud passes through the first external fluid passage 8*a* on the periphery of the turbine rotor 8 to drive the turbine rotor to generate power. A small portion of mud enters the first internal fluid passage 12*a* through the first bearing, then passes through the second internal fluid passage 12*b*, and finally flows out of the generator 100 through the second bearing. Thus, this small portion of mud can effectively lower the temperature at the windings 20, thereby extending the service life of the generator 100 significantly. Furthermore, the small portion of mud can also act as lubricant for the first bearing and the second bearing, and also prevent sand from being deposited thereon, so that the service life of the generator 100 can be further extended significantly.

According to an embodiment of the present disclosure, the generator 100 further comprises a guiding stator 3. The guiding stator 3 is arranged on a third region L3 of the body 1, which is axially adjacent to the second region L2, towards a side of the second region L2 opposite to the first region L1. Therefore, the guiding stator 3 and the turbine rotor 8 are axially adjacent with each other. A second external fluid passage 3*a* is arranged on the periphery of the guiding stator 3. The second external fluid passage 3*a* is aligned with the first external fluid passage 8*a* arranged on the periphery of the turbine rotor 8, or staggered therefrom at a certain angle.

With the guiding stator 3, the impact of mud will be diverted from the turbine rotor 8 to the guiding stator 3, so that the load on the turbine rotor 8 can be effectively decreased, thus the service life of the generator 100 can be further prolonged. In addition, a third internal fluid passage 12*c*, which communicates with the first internal fluid passage 12*a*, is arranged inside the guiding stator 3. In this case, part of the underground fluid can flow past the generator 100 through the third internal fluid passage 12*c*, the first bearing, the first internal fluid passage 12*a*, the second internal fluid passage 12*b*, and the second bearing in succession.

Between the turbine rotor 8 and the body 1, an adjusting ring 17 can be arranged. Under this condition, the first internal fluid passage 12*a* is provided between the turbine rotor 8 and the adjusting ring 17, and the first bearing is provided on the periphery of the adjusting ring 17. With this adjusting ring 17, the size of the first internal fluid passage 12*a* can be more easily controlled, and the manufacturing and assembly of the turbine rotor 8 can be convenient.

The first bearing can comprise, for example, a rotor upper bearing 6 and a radial bearing 7. The rotor upper bearing 6 is arranged on one end of the turbine rotor 8 adjacent to the third region L3, and forms an axial bearing pair with one end of the guiding stator 3 adjacent to the second region L2. In the meantime, the rotor upper bearing 6 and the radial bearing 7, which is arranged on the body 1 or on the adjusting ring 17, form a radial bearing pair.

In one specific embodiment, the generator 100 further comprises a slip ring 5 arranged between the guiding stator 3 and the turbine rotor 8. For example, the slip ring 5 can be fixedly connected with the guiding stator 3 by means of a combination of interference fit and adhesive, thus providing a stable positioning restriction. Thus, under intense vibration and impact underground, the slip ring 5 and the rotor upper bearing 6 of the first bearing will contact each other and form a sliding bearing pair, so that direct contact of the guiding stator 3 with the turbine rotor 8 can be avoided. Therefore, the possibility of turbine rotor 8 being damaged can be reduced.

The second bearing can comprise, for example, a rotor lower bearing 14 arranged on the lower end of the yoke 9 and a body bearing 15 arranged on the body 1. The rotor lower bearing 14 and the body bearing 15 form a sliding bearing pair and an axial thrust bearing pair.

According to the present disclosure, an axial inner passage 18 is formed inside the body 1. A passage 22 penetrating the sidewall of the body 1 is arranged in the first region L1. A sealed contact pin 16 is arranged inside the passage 22, which connects with the windings 20 and extends into the inner passage 18 through an electrical lead 21. According to the present disclosure, the inner passage 18 can be in form of a blind hole for directly outputting the power generated. The inner passage 18 can also be in form of a step shape through-hole along the axis thereof, under which case, when the generator supplies power to the underground system, the inner passage 18 can also serve as a signal passage passing through the generator.

Although the present disclosure has been described with reference to the preferred embodiments, various modifications can be made to the present disclosure without departing from the scope of the present disclosure and components in the present disclosure could be substituted by equivalents. Particularly, as long as there is no structural conflict, all the technical features mentioned in all the embodiments may be combined together in any manner. These combinations are not exhaustively listed and described in the description merely for saving resources and keeping the description concise and brief. Therefore, the present disclosure is not limited to the specific embodiments disclosed in the description, but includes all the technical solutions falling into the scope of the claims.

The invention claimed is:

1. A downhole rotating magnetic field generator, comprising:

a stator assembly, comprising a stationary cylindrical body and windings arranged in a first region of the body, and a rotor assembly, comprising a permanent magnet arranged radially outside of the windings and a turbine rotor arranged in a second region of the body which is axially adjacent to the first region, wherein the turbine rotor and the permanent magnet are fixedly connected with each other along an axial direction, and arranged on the body at both ends of the rotor assembly respectively through a first bearing and a second bearing, wherein a first external fluid pass is arranged on the periphery of the turbine rotor, and wherein a guiding stator is arranged on a third region of the body that is axially adjacent to the second region, a second external fluid passage is arranged on the periphery of the guiding stator, and a third internal fluid passage communicated with the first internal fluid passage is arranged inside the guiding stator.

2. The generator according to claim 1, wherein a first internal fluid passage and a second internal fluid passage, which are communicated with each other, are formed respectively between the turbine rotor and the body and between the permanent magnet and the windings, so that a part of fluid passing through the generator enters the first internal fluid passage through the first bearing, and then is discharged through the second bearing after flowing through the second internal fluid flow passage.

3. The generator according to claim 1, wherein an adjusting ring is arranged between the turbine rotor and the body, the first internal fluid passage is arranged between the turbine rotor and the adjusting ring, and the first bearing is placed on the periphery of the adjusting ring.

4. The generator according to claim 3, wherein a slip ring is arranged between the guiding stator and the first bearing.

5. The generator according to claim 1, wherein an insulation layer is formed radially outside of the windings.

6. The generator according to claim 5, wherein a yoke and a non-magnetically conductive shield are respectively arranged radially outside and inside of the permanent magnet, the second inner fluid passage is arranged between the insulation layer and the non-magnetically conductive shield.

7. The generator according to claim 1, wherein the body comprises an axial inner passage and a radial passage arranged in the first region thereof, and an electrical lead, which passes through a radial through-hole in a sealed manner and connects to the windings, for outputting the electric power and/or signal generated.

8. A downhole rotating magnetic field generator, comprising:

a stator assembly, comprising a stationary cylindrical body and windings arranged in a first region of the body, and a rotor assembly, comprising a permanent magnet arranged radially outside of the windings and a turbine rotor arranged in a second region of the body which is axially adjacent to the first region, wherein the turbine rotor and the permanent magnet are fixedly connected with each other along an axial direction, and arranged on the body at both ends of the rotor assembly respectively through a first bearing and a second bearing, wherein an adjusting ring is arranged between the turbine rotor and the body, the first internal fluid passage is arranged between the turbine rotor and the adjusting ring, and the first bearing is placed on the periphery of the adjusting ring.

9. The generator according to claim 8, wherein a slip ring is arranged between the guiding stator and the first bearing.

10. The generator according to claim 8, wherein an insulation layer is formed radially outside of the windings.

11. The generator according to claim 10, wherein a yoke and a non-magnetically conductive shield are respectively arranged radially outside and inside of the permanent magnet, the second inner fluid passage being is arranged between the insulation layer and the non-magnetically conductive shield.

12. The generator according to claim 8, wherein the body comprises an axial inner passage and a radial passage arranged in the first region thereof, and an electrical lead, which passes through a radial through-hole in a sealed manner and connects to the windings, is used to output for outputting the electric power and/or signal generated.

13. A downhole rotating magnetic field generator, comprising:

a stator assembly, comprising a stationary cylindrical body and windings arranged in a first region of the body, and a rotor assembly, comprising a permanent magnet arranged radially outside of the windings and a turbine rotor arranged in a second region of the body which is axially adjacent to the first region, wherein the turbine rotor and the permanent magnet are fixedly connected with each other along an axial direction, and arranged on the body at both ends of the rotor assembly respectively through a first bearing and a second bearing, and wherein the first bearing comprises a rotor upper bearing and a radial bearing, and the second bearing comprises a rotor lower bearing and a body bearing.

14. The generator according to claim 13, wherein an insulation layer is formed radially outside of the windings.

15. The generator according to claim 14, wherein a yoke and a non-magnetically conductive shield are respectively arranged radially outside and inside of the permanent magnet, the second inner fluid passage being is arranged between the insulation layer and the non-magnetically conductive shield.

16. The generator according to claim 13, wherein the body comprises an axial inner passage and a radial passage arranged in the first region thereof, and an electrical lead, which passes through a radial through-hole in a sealed manner and connects to the windings, is used to output for outputting the electric power and/or signal generated.

* * * * *